US009105426B2

(12) United States Patent
Gouhl et al.

(10) Patent No.: US 9,105,426 B2
(45) Date of Patent: Aug. 11, 2015

(54) WIRING DEVICE WITH CONTACT DAMPENING

(71) Applicants: Erik Gouhl, Fayetteville, GA (US); Robin Lu, Changping Town (CN)

(72) Inventors: Erik Gouhl, Fayetteville, GA (US); Robin Lu, Changping Town (CN)

(73) Assignee: Cooper Technologies Company, Houston, TX (US)

( * ) Notice: Subject to any disclaimer, the term of this patent is extended or adjusted under 35 U.S.C. 154(b) by 193 days.

(21) Appl. No.: 13/790,656

(22) Filed: Mar. 8, 2013

(65) Prior Publication Data

US 2014/0251774 A1 Sep. 11, 2014

(51) Int. Cl.

| | |
|---|---|
| ***H01H 1/50*** | (2006.01) |
| ***H01H 23/20*** | (2006.01) |
| *H01H 23/14* | (2006.01) |

(52) U.S. Cl.

CPC ..... *H01H 23/205* (2013.01); *H01H 1/50* (2013.01); *H01H 23/146* (2013.01)

(58) Field of Classification Search

CPC ..... H01H 3/60; H01H 71/525; H01H 1/50; H01H 23/146; H01H 23/205

USPC ..... 200/401, 301, 288, 339; 174/42

See application file for complete search history.

(56) References Cited

U.S. PATENT DOCUMENTS

| | | | | |
|---|---|---|---|---|
| 4,042,799 A * | 8/1977 | Reuting | ..... | 200/288 |
| 6,903,293 B2 * | 6/2005 | Sasaki | ..... | 200/339 |
| 7,737,377 B1 * | 6/2010 | Dodal et al. | ..... | 200/339 |

* cited by examiner

*Primary Examiner* — Renee Luebke
*Assistant Examiner* — Ahmed Saeed
(74) *Attorney, Agent, or Firm* — King & Spalding LLP

(57) ABSTRACT

An electrical wiring device includes dampening member placed in contact with a stationary contact. The dampening member absorbs and thus decreases at least a portion of the vibration that occurs in the stationary contact when it is impacted by a movable contact in the electrical wiring device. Thus, the noise associated with the impact is lessened. In certain exemplary embodiments, the dampening member is a bumper cap which partially encases a portion of the stationary contact. In certain exemplary embodiments, the dampening member is a bumper pad intimately disposed between an edge of the stationary contact and a wall of the housing, such that movement or vibration of the stationary contact is lessened.

15 Claims, 4 Drawing Sheets

WIRING DEVICE WITH CONTACT DAMPENING

TECHNICAL FIELD

The present invention relates generally to electrical wiring devices and more particularly, to electrical wiring devices with contact dampening for noise reduction.

BACKGROUND

Wiring devices, such as toggle style switches, are often used to turn a load on and off. Specifically, a toggle switch is coupled to a movable contact inside the wiring device. The movable contact is generally configured to move back and forth between two stationary contacts when the toggle switch is flipped. For example, when the toggle switch is flipped, the movable contact moves from being in contact with the first stationary contact to being in contact with the second stationary contact. Thus, the circuit is either opened or closed. Generally, when the movable contact makes contact with one of the stationary contacts, an associated impact noise is produced. The impact noise is generated from both the collision of the movable contact and the stationary contact as well as from resulting vibrations created from the movable contact coming in contact with one of the stationary contacts. The noise may be further amplified by conventional wiring device housing.

SUMMARY

An exemplary embodiment of the present invention includes a wiring device with contact dampening. The wiring device includes a housing having a plurality of walls forming a cavity therein and a toggle assembly disposed partially within the cavity. The toggle assembly includes a toggle, a movable contact including a distal end and a proximal end, in which the movable contact is coupled to the toggle at the proximal end, a cradle disposed within the cavity, in which the toggle is pivotally coupled to the cradle. The wiring device further includes a first stationary contact disposed within the cavity and at least partially aligned with the distal end of the movable contact, and a dampening member having a first side and a second side. The dampening member is disposed against one of the plurality of walls of the housing on the first side, and an edge of the first stationary contact is in contact with the dampening member on the second side.

Another exemplary embodiment of the present invention includes a wiring device with contact dampening. The wiring device includes a housing having a plurality of walls forming a cavity therein and a toggle assembly disposed partially within the cavity. The toggle assembly includes a toggle, a movable contact including a distal end and a proximal end, in which the movable contact is coupled to the toggle at the proximal end, and a cradle disposed within the cavity, in which the toggle is pivotally coupled to the cradle. The wiring device further includes a first stationary contact disposed within the cavity and at least partially aligned with the distal end of the movable contact, and a first dampening member having a base portion and a wall portion, the wall portion encircling and extending orthogonally from the base portion, forming a slot therein, and an edge of the first stationary contact is intimately disposed within the slot.

Another exemplary embodiment of the present invention includes a wiring device with contact dampening. The wiring device includes a housing including a plurality of walls and forming a cavity therein, a first stationary contact disposed within the cavity of the housing, and a first dampening member positioned in contact with at least a portion of the first stationary contact.

Another exemplary embodiment of the present invention includes a wiring device with contact dampening. The wiring device includes a housing having a plurality of walls forming a cavity therein and a toggle assembly disposed at least partially within the cavity. The toggle assembly includes a toggle, a movable contact having a distal end and a proximal end, in which the movable contact is coupled to the toggle at the proximal end, and a cradle having a central opening, in which the toggle is pivotally coupled to the cradle and the movable contact extends through the central opening. The wiring device further includes a first stationary contact and a second stationary contact disposed within the cavity and at least partially aligned with the distal end of the movable contact, and a dampening member. The dampening member includes a first bumper portion and a second bumper portion, in which an edge of the first stationary contact is in contact with the first bumper portion and an edge of the second stationary contact is in contact with the second bumper portion. The dampening member further includes a first bumper wall extending orthogonally from an outer edge of the first bumper portion along a portion of the first stationary contact and a second bumper wall extending orthogonally from an outer edge of the second bumper portion along a portion of the second stationary contact. The dampening member also includes a first connector wall and a second connector wall, in which the first connector wall extends from a first end of the first bumper wall to a first end of the second bumper wall, and the second connector wall extends from a second end of the first bumper wall to a second end of the second bumper wall.

BRIEF DESCRIPTION OF THE DRAWINGS

The foregoing and other features and aspects of the invention are best understood with reference to the following description of certain exemplary embodiments, when read in conjunction with the accompanying drawings, wherein.

BRIEF DESCRIPTION OF EXEMPLARY EMBODIMENTS

Figure 1:
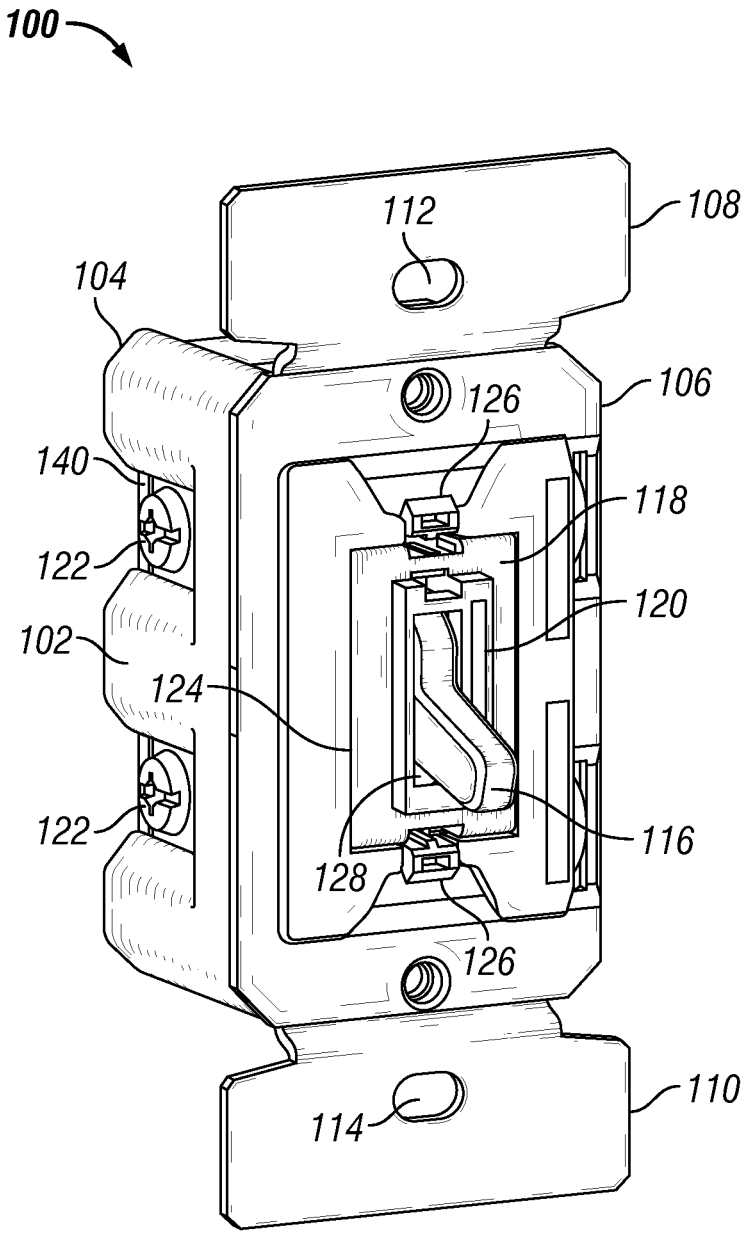
FIG. 1 is a perspective view of a wiring device in accordance with an exemplary embodiment of the present invention.

The embodiments of the present invention are directed to wiring devices having movable contacts. Although the description of exemplary embodiments is provided below in conjunction with a three-way toggle style wiring device, alternate embodiments of the invention are applicable to other types of electrical wiring devices including, but not limited to, paddle switches, two-way toggle switches, other style of switches, and any other electrical wiring device known to people having ordinary skill in the art. The invention is better understood by reading the following description of non-limiting, exemplary embodiments with reference to the attached drawings, wherein like parts of each of the figures are identified by like reference characters, and which are briefly described as follows.

Figure 2:
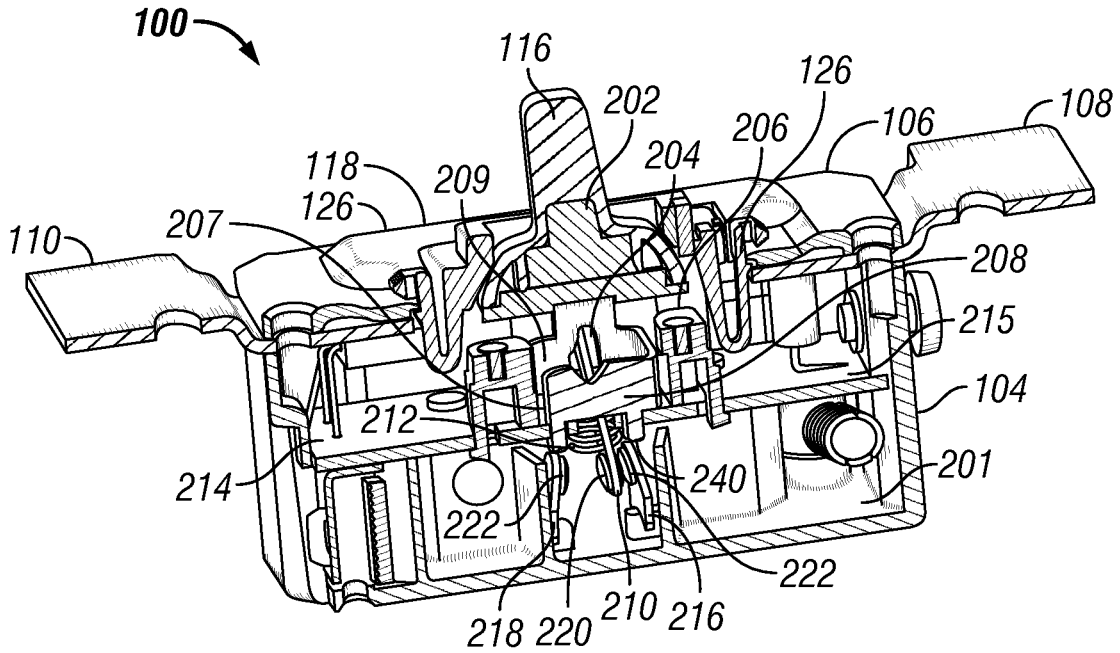
FIG. 2 is a side cross-sectional view of the wiring device of FIG. 1 with the contact dampening feature removed in accordance with an exemplary embodiment of the present invention.

The present disclosure presents a wiring device with contact dampening, which reduces noise associated with the mating of a movable contact 210 (FIG. 2) and a stationary contact 216, 218 (FIG. 2) within the wiring device. FIG. 1 is a perspective view of a wiring device 100 with contact dampening in accordance with an exemplary embodiment of the present invention. Referring to FIG. 1, the wiring device 100 is substantially rectangularly shaped and includes, as is seen externally, a housing 102, a first coupling band 108, a second coupling band 110, an outer toggle 116, an optional skirt 118, and a plurality of terminal screws 122. The housing 102 is a substantially rectangularly shaped shell that includes an inner cavity 201 (FIG. 2) therein, but is capable of being formed in other geometric or non-geometric shapes if desired. The housing 102 is dimensioned to fit within a wall box (not shown) according to some exemplary embodiments. In the illustrated exemplary embodiment, the housing 102 includes a housing base 104 and a housing top 106, which are fabricated separately and joined together to form the housing 102. The housing base 104 and the housing top 106 have similar profiles such that when joined, the profiles are substantially aligned. In certain exemplary embodiments, the inner cavity 201 (FIG. 2) is located within the housing base 104, in which electronic components and contacts are disposed. The housing top 106 generally remains visible to an end-user once the wiring device 100 is installed within the wall box, before a wall plate (not shown) is installed according to certain exemplary embodiments. When the wall plate is installed, the housing 102, including the housing top 106 is generally not visible to the end-user according to certain exemplary embodiments. In certain exemplary embodiments, the housing top 106 includes a substantially rectangular opening 124 located centrally within the housing top 106. At least a portion of the outer toggle 116 and the skirt 118 are disposed within and/or through the opening 124. In certain exemplary embodiments, the material and configuration of the housing 102 is chosen to minimize the amplification or acoustic effects of the housing 102 and/or cavity 201 (FIG. 2). For example, in certain exemplary embodiments, the housing 102 is fabricated using a relatively dense material such as polyvinyl chloride or any other suitable material ascertainable with respect to the present disclosure.

The skirt 118 is disposed within the opening 124 of the housing top 106. The skirt 118 is substantially rectangularly shaped and has an outer profile that is substantially similar to the profile of the opening 124 in the housing top 106. In certain exemplary embodiments, the skirt 118 is coupled to the housing top 106 within the opening 124 via a coupling mechanism 126 such as a snap-fit mechanism. In certain exemplary embodiments, the coupling mechanism 126 is releasable, such that the skirt 124 can be attached to and detached from the housing top 106. Alternatively, in certain exemplary embodiments, the skirt 118 is permanently coupled to the housing top 106 within the opening 124. In certain exemplary embodiments, the skirt 118 is fabricated with the housing top 106 as a single component. The skirt 118 includes a toggle opening 128 through which at least a portion of the outer toggle 116 is disposed. The toggle opening 128 is rectangularly shaped and has a length capable of accommodating the different potential positions of the outer toggle 116. In certain exemplary embodiments, and as illustrated in FIG. 1, the skirt 118 further includes a dimmer slider slot 120 through which a dimmer slider (not seen) is disposed, such that the dimmer slider is coupled to a PCB assembly 214 (FIG. 2) within the housing 102 while remaining accessible to an end-user. The dimmer slider slot 120 is substantially rectangular or linear, and has a length capable of accommodating the range of potential positions of the dimmer slider (not seen).

The first coupling band 108 and the second coupling band 110 are both partially disposed in the housing 102, generally between the housing base 104 and the housing top 106. In certain exemplary embodiments, the first coupling band 108 and the second coupling band 110 are formed as a single component with a middle portion (not shown). However, in some exemplary embodiments, the first coupling band 108 and the second coupling band 110 are formed separately from one another and are optionally coupled to each other within the housing 102. Generally, the first coupling band 108 and the second coupling band 110 extend lengthwise of the housing 102 in opposite directions, respectively. The first coupling band 108 includes a first coupling aperture 112 formed within the first coupling band 108, and the second coupling band 110 includes a second coupling aperture 114 formed within the second coupling band 110. These apertures 112 and 114 are used to couple the wiring device 100 to the wall box using a screw (not shown) or other fastening device known to those having ordinary skill in the art. The first coupling band 108 and the second coupling band 110 are fabricated using a metal, such as steel, but are fabricated using other suitable materials known to people having ordinary skill in the art in other exemplary embodiments.

The terminal screws 122 are disposed through a housing wall 140, which extends orthogonally away from the perimeter of the housing base 104 towards the housing top 106, such that the terminal screws 122 are partially disposed within the housing 102 and partially disposed external to the housing 102. Hence, at least a portion of the terminal screws 122 are accessible to an end-user when the wiring device 100 is assembled. The terminal screws 122 are electrically coupled to one or more electrical components within the housing 102. The terminal screws 122 are also configured to be electrically coupled to respective power source wires (not shown), load wires (not shown), or travelers (not shown) external to the housing 102. The terminal screws 122 are fabricated from a conductive material such as metal or any other suitable material. Thus, the power source and load wires are coupled to the one or more components within the housing 102 via the terminal screws 122. The terminal screws 122 may be tightened and loosened with respect to the housing 102 to allow the power source and load wires to be coupled to and decoupled from the wiring device 100.

In certain exemplary embodiments, the wiring device 100 is an all-load switch. As such, the wiring device 100 is compatible for use with a variety of load types, such as incandescent lights, LEDs, fluorescent lights, and so forth. In certain exemplary embodiments, the wiring device 100 includes a dimmer. In certain exemplary embodiments, the wiring device 100 includes a dimmer with preset, which has the ability to open and close the associated circuit with the load set to a predetermined output level. However, in certain other exemplary embodiments, the wiring device 100 is configured to function in other ways not detailed herein for sake of brevity.

Figure 3:
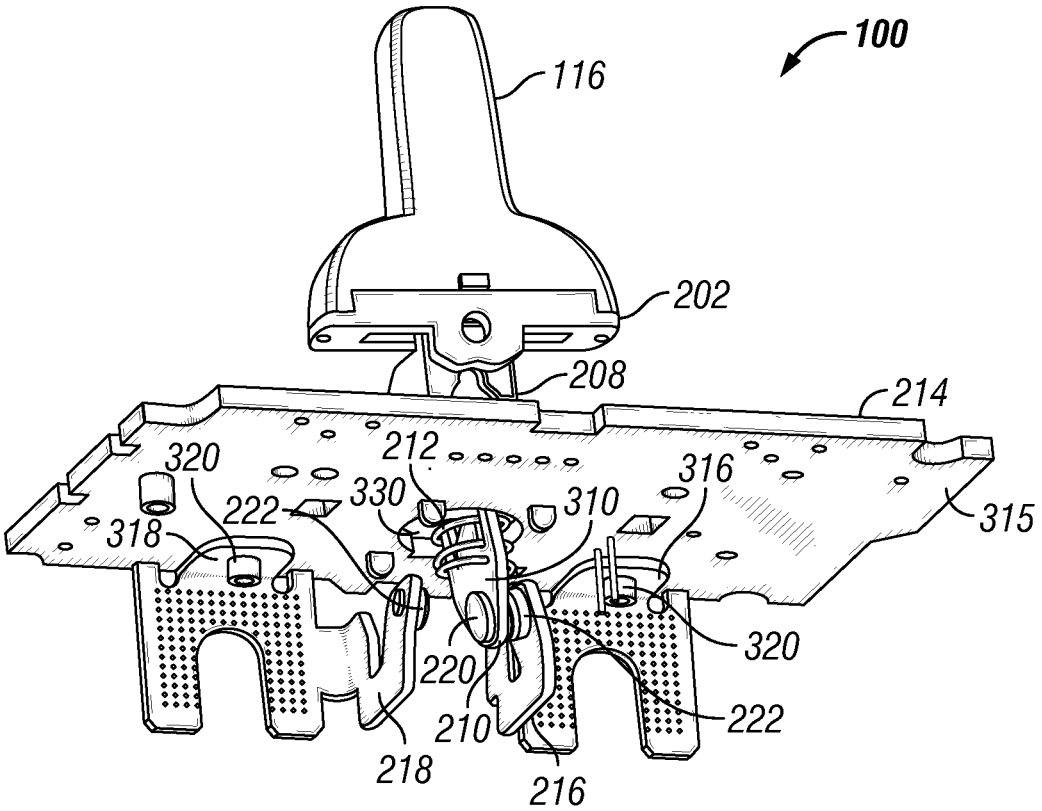
FIG. 3 is a perspective view of a portion of an internal switch assembly of the wiring device of FIG. 1 in accordance with an exemplary embodiment of the present invention.

FIG. 2 is a side cross-sectional view of the wiring device 100 with one or more contact dampening features removed, in accordance with an exemplary embodiment of the present invention. FIG. 3 further shows a partially disassembled wiring device 100. Referring to FIGS. 2 and 3, the wiring device 100 further includes an inner toggle 202, a toggle support 206, a cradle 208, a movable contact 210, a spring 212, a PCB assembly 214, a first stationary contact 216, and a second stationary contact 218.

Figure 5:
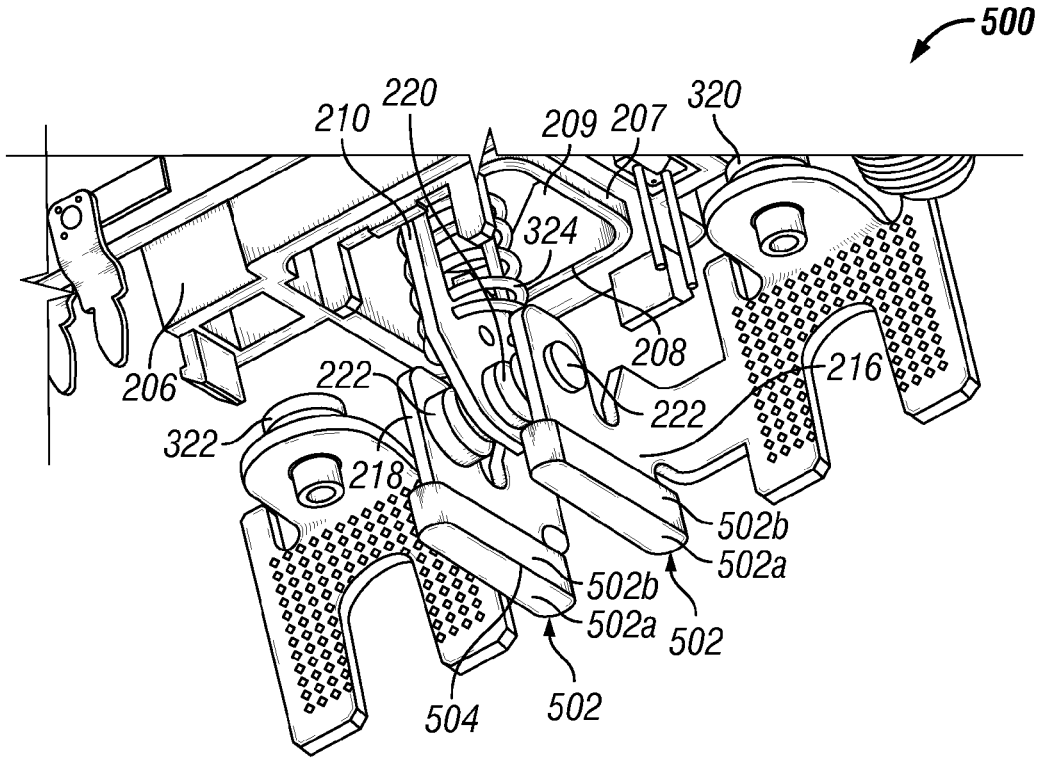
FIG. 5 is a perspective view of a portion of an internal switch assembly of a wiring device with contact dampening in accordance with another exemplary embodiment of the present invention.

In certain exemplary embodiments, the PCB assembly 214 is disposed horizontally across the length of and within the housing 102. The PCB assembly 214 is supported by certain structures such as walls, nodes, screws, platforms, standoffs, etc. within the housing 102 in order to maintain its position. In certain exemplary embodiments, the PCB assembly 214 includes an electrical circuit featuring a number of electrical components and/or passive elements electrically coupled together for carrying out certain functional purposes of the wiring device 100. The PCB assembly 214 includes a first side 215 and a second side 315. The first side 215 faces the housing top 106 and the second side 315 faces the housing base 104 opposite the first side 215. The PCB assembly 214 further includes a PCB aperture 240 through which the movable contact 210 and the spring 212 extend from the first side 215 of the PCB to the second side 315. In certain exemplary embodiments, the first side 215 of the PCB assembly 214 includes a toggle support 206 disposed thereon. In certain exemplary embodiments, the toggle support 206 is securely coupled to the first side 215 of the PCB assembly 214 via one or more coupling mechanisms such as snap hooks. Thus, the toggle support 206 is securely disposed on the first side 215 of the PCB assembly 214 between the housing top 106 and the PCB assembly 214. In certain exemplary embodiments, the inner toggle 202 is disposed on top of the toggle support 206 opposite the PCB assembly 214. FIG. 5 provides a bottom-up perspective view of the toggle support 206 without the PCB assembly 214 (FIG. 2). Referring to FIGS. 2 and 5, the toggle support 206 includes a generally central support opening 207 through which the cradle 208, which is discussed in further detail below. movable contact 210, and spring 212 are at least partially disposed. The support opening 207 is substantially aligned with the PCB aperture 240.

In certain exemplary embodiments, the cradle 208 is coupled to the first side 215 of the PCB assembly 214 within the opening 207 of the toggle support 206. The cradle 208 further includes a cradle opening 209 which is substantially aligned with the aperture 240 in the PCB assembly 214. Thus, the movable contact 210 and spring 212 extend from the inner toggle 202 and first side 215 of the PCB assembly 214, through the cradle opening 209 and PCB aperture 240, to the second side 315 (FIG. 3) of the PCB assembly 214.

Referring to FIGS. 2 and 3, in certain exemplary embodiments, at least a portion of the inner toggle 202 is substantially disposed within a cavity formed within the outer toggle 116 but generally hidden from external view. However, when the end-user actuates, or flips, the outer toggle 116, the action is translated to the inner toggle 202, and the inner toggle 202 moves accordingly. In certain exemplary embodiments, the inner toggle 202 includes a toggle extension 204 which extends substantially orthogonally from the inner toggle 202 towards the PCB assembly 214 within the housing 102. The inner toggle 202 is pivotally coupled to cradle 208 opposite the PCB assembly 214. Thus, The cradle 208 provides an axis of rotation for the inner toggle 202, allowing it to be switched from a first position to a second position. In certain exemplary embodiments, there is approximately 6.5 degrees of rotation between the first position and the second position, however, this degree of rotation varies in other exemplary embodiments. In certain exemplary embodiments, the movable contact 210 is coupled to the toggle extension 204 opposite the inner toggle 202. The movable contact 210 extends from the toggle extension 204, away from the inner toggle 202, and through the PCB aperture 240. Switching, or actuation, of the outer toggle 116 by an end-user moves the inner toggle 202, which moves the toggle extension and the movable contact 210 accordingly in a pivoted motion about the cradle 208. In certain exemplary embodiments, the direction of movement of the movable contact 210 is opposite that of the outer toggle 116. In certain exemplary embodiments, the movable contact 210 includes a two-sided contactor 220 disposed at a distal end 310 of the movable contact 210. The two-sided contactor 220 extends through and past the thickness of the movable contact 210 such that the contactor 220 is exposed and/or protruding from both sides of the movable contact 210. The movable contact 210 and the two-sided contactor 220 are fabricated using a conductive material such as steel, copper, and the like. Thus, the two-sided contactor 220 is conductively coupled to the movable contact 210, or movable contact arm. In alternative exemplary embodiments, there are two contactors 220, such that each contactor 220 is coupled to opposite sides of the movable contact 210.

In certain exemplary embodiments, the spring 212 is disposed vertically along the movable contact 210 such that coils of the spring 212 protrude from either side of the movable contact 210. In certain exemplary embodiments, the spring 212 provides biasing of the movable contact arm 210 as it moves from the first position and the second position, and which provides a contact force for maintaining conductivity between the movable contact 210 and the respective stationary contacts 216, 218.

The first stationary contact 216 and second stationary contact 218 are disposed onto the second side 315 of the PCB assembly 214 on opposite sides of the PCB aperture 240. In certain exemplary embodiments, the first stationary contact 216 is conductively coupled to a first stationary contact flange 316 and the second stationary contact 218 is conductively coupled to a second stationary contact flange 318. The first and second stationary contacts 216, 218 are secured and electrically coupled to the PCB assembly 214 via the respective stationary contact flanges 316, 318. Specifically, the stationary contact flanges 316, 318 are disposed against the second side 315 of the PCB assembly 214 and are secured to the PCB assembly 214 via conductive rivets 320, through-hole elements, or the like, which electrically couple the first stationary contact 216, or first stationary contact arm, and the second stationary contact 218, or second stationary contact arm, to respective circuit elements on the first side 215 of the PCB assembly 214. The first and second stationary contacts 216, 218 extend to positions on opposing sides of and orthogonal to the PCB aperture 240 such that the first and second stationary contacts 216, 218 are on opposite sides of and facing the movable contact 210. In certain exemplary embodiments, each of the stationary contacts 216, 218 include at least one contactor 222 disposed therein. The contactors 222 are conductively coupled to the respective stationary contact arms 216, 218 and disposed at areas of the stationary contact arms 216, 218 which are in substantial alignment with the two-sided contactor 220 of the movable contact 210. As such, the two-sided contactor 220 is able to be put in contact with the respective contactor 222 of the first and second contacts 216, 218, respectively, as the movable contact 210 is put into a first position or a second position when the outer toggle 116 is switched or actuated accordingly. Specifically, when the movable contact 210 is in the first position, the two-sided contactor 220 of the movable contact 210 is urged and held in conductive contact with the contactor 222 of the first stationary contact 216, thereby creating a conductive path between the movable contact 210 and the first stationary contact 216. Likewise, when the movable contact 210 is put into the second position, the movable contact moves such that the two-sided contactor 220 is urged and held in conductive contact with the contactor 222 of the second stationary contact 218, thereby creating a conductive path between the movable contact 210 and the second stationary contact 218.

In certain exemplary embodiments, the first stationary contact 216, the second stationary contact 218, and the movable contact 210 are switching elements of a three-way switch. Typically, one or more three-way switches can be used together to control a single load from multiple locations. For example, a first three-way switch and a second three-way switch that are configured to control a singe load can be located in a first location and a second location, respectively. At the first location, the movable contact 210 of the first three-way switch is coupled to a power source. In the second location, the movable contact 210 of the second three-way switch is electrically coupled to the load. The first stationary contact 216 of the first three-way switch is electrically coupled to the first stationary contact 216 of the second three-way switch, and the second stationary contact 218 of the first three-way switch is electrically coupled to the second stationary contact 218 of the second three-way switch. In certain exemplary embodiments, the stationary contacts are connected in the configuration described above by travelers. This configuration allows either of the first and second three-way switches to be able to connect the power source to the load by switching the movable contact 210 from one stationary contact to the other. Therefore, when the movable contact 210 of either three-way switch is switched from one position to another, the load is either connected to the power supply or disconnected. Specifically, if the load is currently connected to the power supply, then actuating either of the two switches disconnects the load to the power supply, and vice versa. In certain other exemplary embodiments, the movable contact 210 is coupled to a load and the first stationary contact 216 is coupled to the load (or vice versa), and the second stationary contact 218 is an open contact, which is not coupled to a load. Thus, when the movable contact 210 is put in the first position and in contact with the first stationary contact 216, a circuit is completed from the power source to the load. Conversely, when the movable contact 210 is put in the second position and in contact with the second stationary contact 218, the circuit is open and a load is not energized.

Figure 4:
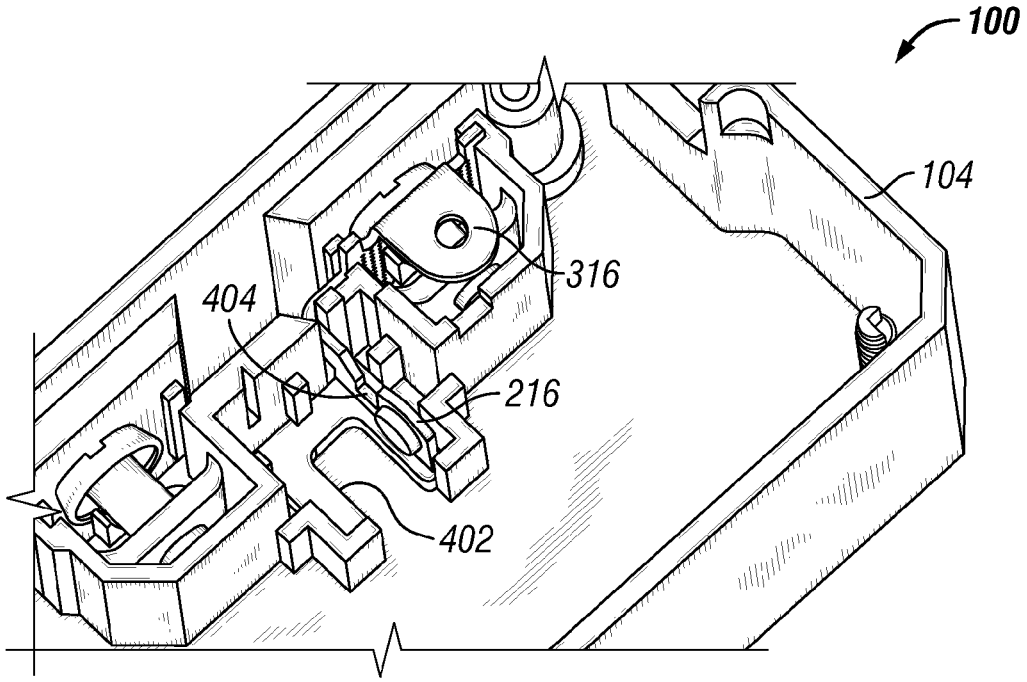
FIG. 4 is an internal perspective view of a partially disassembled wiring device of FIG. 1 with contact dampening in accordance with an exemplary embodiment of the present invention.

FIG. 4 shows a internal view of a partially disassembled wiring device 400 with contact dampening in accordance with an exemplary embodiment of the present invention. Referring to FIG. 4, the electrical wiring device 100 includes a bumper pad 402 disposed between the housing base 104 and the first stationary contact 216. Specifically, in certain exemplary embodiments, and as illustrated herein, the bumper pad 402 is disposed against the housing base 104, between the housing base 104 and an edge 404 of the first stationary contact 216. In certain exemplary embodiments, the bumper pad 402 has a dampening or visco-elastic quality. Thus, in certain exemplary embodiments, the edge 404 of the first stationary contact arm 216 presses against or depresses into the bumper pad 402 such that vibrations in the first stationary contact arm 216 are at least partially absorbed and dampened by the bumper pad 402. Thus, when the movable contact 210 swings into contact with the first stationary contact 216, the vibration in the first stationary contact 216 caused by the impact is dampened. As such, the associated noise is diminished as well. Though not illustrated in FIG. 4, the bumper pad 402 also is disposed between the second stationary contact 218 (FIG. 2) and the housing base 104 in substantially the same manner as described above. Thus, when the movable contact 210 swings into contact with the second stationary contact 218 (FIG. 2), the vibration in the second stationary contact 218 (FIG. 2) caused by the impact is dampened. In certain exemplary embodiments, the bumper pad 402 is U-shaped and includes two protrusions connected by a middle portion. However, in certain other exemplary embodiments, the bumper pad 402 is formed in another geometric or non-geometric shape. In certain exemplary embodiments, the bumper pad 402 is made as one continuous piece. In certain other exemplary embodiments, the bumper pad 402 is made of two or more separate pieces. In certain exemplary embodiments, the bumper pad 402 is disposed against a different portion of the housing 104 or against a different portion of the first movable contact 216 than illustrated and/or described herein. In certain exemplary embodiments, the bumper pad 402 is fabricated using a dampening material such as rubber, silicon, soft plastic, and the like. In certain exemplary embodiments, the bumper pad 402 is fabricated from stamped or die-cut process.

FIG. 5 is a perspective view of a partial internal switch assembly 500 of a wiring device with contact dampening in accordance with another exemplary embodiment of the present invention. In certain exemplary embodiments, and as illustrated in FIG. 5, the first stationary contact 216 includes a bumper cap 502 disposed around the edge 404 of the first stationary contact 216. In certain exemplary embodiments, the bumper cap 502 includes a base 502*a* and a wall 502*b* extending orthogonally from the base 502*a* which wraps around the edge 404 of the first stationary contact 216, the edge 404 being an area of the first stationary contact 216 distal to the contactor 222. Likewise, the second stationary contact 218 includes the bumper cap 502 disposed around an edge 504 of the second stationary contact 218. In certain exemplary embodiments, the bumper caps 502 are fabricated using a dampening material such as rubber, silicon, soft plastic, other visco-elastic materials, and the like. The bumper caps 502 are disposed around and against the respective edges 502, 504 of the first and second stationary contact arms 216, 218. Thus, when the movable contact 210 swings into contact with the first stationary contact 216, the vibration in the first stationary contact 216 caused by the impact is dampened by the bumper cap 502 disposed on the first stationary contact 216. Likewise, when the movable contact 210 swings into contact with the second stationary contact 218, the vibration in the second stationary contact 218 caused by the impact is dampened. As such, the associated noise of the impact is diminished as well. In certain exemplary embodiments, the bumper cap 502 takes on a configuration different than that illustrated and described herein. For example, in certain exemplary embodiments, the bumper cap 502 lacks a base 502*a*, such that the bumper cap 502 only includes the wall 502*b* encircling the edge 404. In certain exemplary embodiments, the wall 502*b* is disposed on one side of the edge 404 rather than encircling the edge 404. In certain exemplary embodiments, the bumper cap 502 is fabricated using a material such as rubber, silicon, plastic, and the like. In certain exemplary embodiments, the bumper pad 402 is fabricated from injection molding process. According to certain exemplary embodiments, the bumper caps 502 are used in conjunction with, or independently from, the bumper pads 402 (FIG. 4) depending upon design choices.

Figure 6:
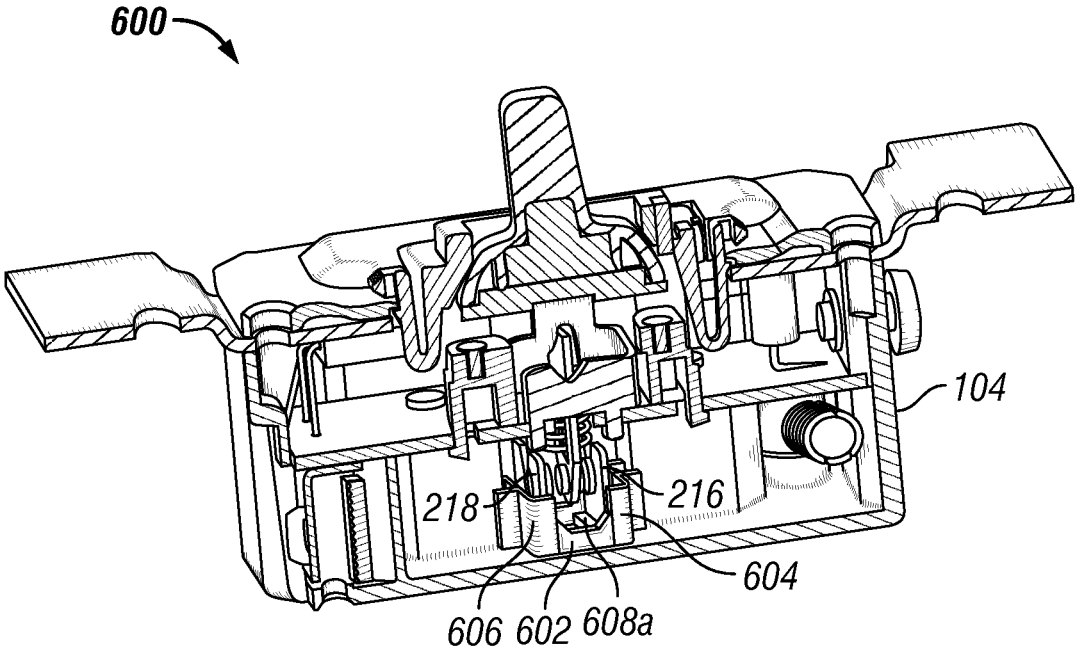
FIG. 6 is a side cross-sectional view of a wiring device with contact dampening in accordance with another exemplary embodiment of the present invention.
Figure 7:
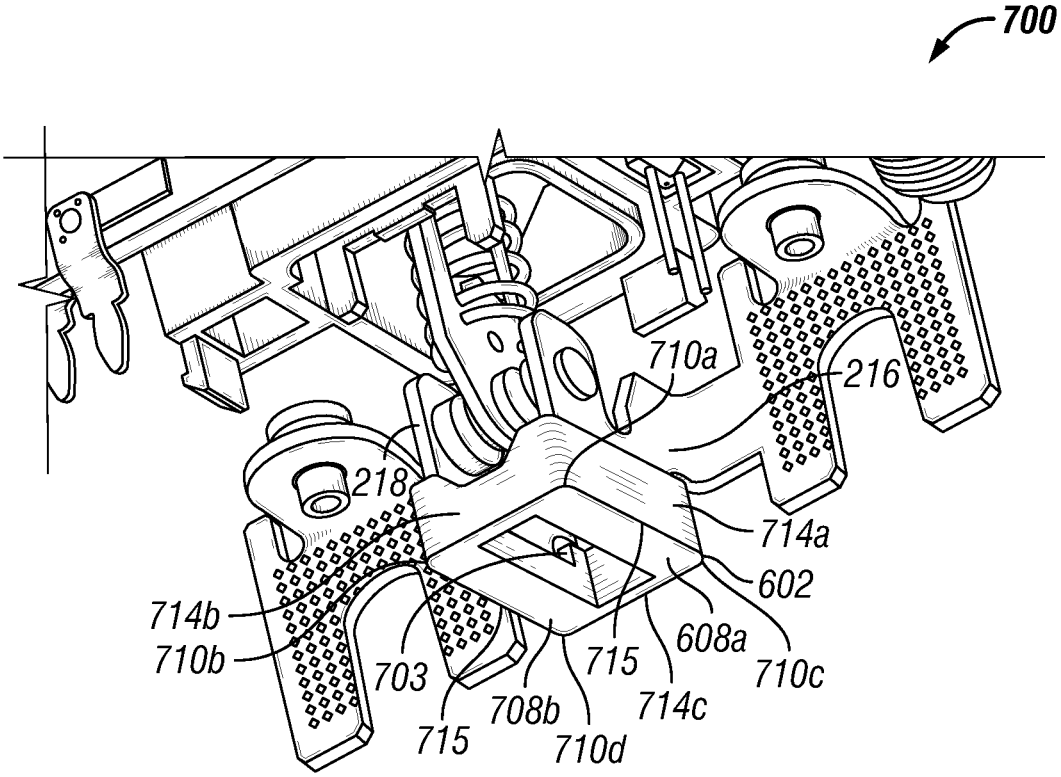
FIG. 7 is a perspective view of a portion of an internal switch assembly of the wiring device of FIG. 6 in accordance with an exemplary embodiment of the present invention.

FIG. 6 is a side cross-sectional view of a wiring device 600 with contact dampening in accordance with another exemplary embodiment of the present invention. FIG. 7 is a perspective view of a portion of an internal switch assembly 700 of the wiring device 600 in accordance with the exemplary embodiment of the present invention. The wiring device 600 is similar to the wiring device 100 (FIG. 1) except for the contact dampening component. Referring to FIGS. 6 and 7, certain exemplary embodiments of the wiring device 600 include a one-piece bumper cap 602. The one-piece bumper cap 602 includes a first bumper portion 608*a* disposed between at least the first stationary contact 216 and the housing 104 and a second bumper portion 708*b* disposed between at least the second stationary contact 218 and the housing 104. The one-piece bumper cap 602 also includes a first bumper wall 714*a* extending orthogonally from an outer edge 715 of the first bumper portion 608*a* upward along the first stationary contact 216, and a second bumper wall (not shown) extending orthogonally from an outer edge 715 of the second bumper portion 708*b* upward along the second stationary contact 218. In certain exemplary embodiments, the one-piece bumper cap 602 also includes one or more inner walls 703 extending orthogonally from the second bumper portion 708*b*, alongside and adjacent to, at least a portion of the second stationary contact 218 opposite the second bumper wall (not shown). Likewise, in certain exemplary embodiments, the one-piece bumper cap 602 includes one or more inner walls 703 extending orthogonally from the first bumper portion 608*a*, alongside and adjacent to, at least a portion of the first stationary contact 216 opposite the first bumper wall 714*a*. In certain exemplary embodiments, the one-piece bumper cap 602 also includes a first connector wall 714*b* and a second connector wall 714*c*. The first connector wall 714*b* extends from a first end 710*a* of the first bumper wall 714*a* to a first end 710*b* of the second bumper wall. Likewise, the second connector wall 714*c* extends from a second end 710*c* of the first bumper wall 714*a* to a second end 710*d* of the second bumper wall. Thus, the first and second stationary contacts 216, 218 are generally surrounded by the one-piece bumper cap 602. In certain exemplary embodiments, the one-piece bumper cap 602 is slightly stretched to fit around the stationary contacts 216, 218. As such, vibrations generated in the first and second stationary contacts 216, 218 are at least partially absorbed and dampened by the one-piece bumper cap 602. In certain exemplary embodiments, the one-piece bumper cap 602 is fabricated using a dampening material such as rubber, silicon, soft plastic, other visco-elastic materials, and the like. In certain exemplary embodiments, the wiring device 600 further includes a first barrier wall 604 and a second barrier wall 606. The first barrier wall 604 is disposed inside the housing 104, adjacent to, and partially around, the first bumper wall 714*a* such that the first barrier 604 is generally aligned with the first stationary contact 216. Likewise, the second barrier wall 606 also is disposed inside the housing 104, adjacent to, and partially around, the second bumper wall such that the second barrier 606 is generally aligned with the second stationary contact 218. Thus, the one-piece bumper pad 602 and the stationary contacts 216, 218 are disposed and held in place between the first and second barrier walls 604, 606.

Although each exemplary embodiment has been described in detail, it is to be construed that any features and modifications that are applicable to one exemplary embodiment are also applicable to the other exemplary embodiments. Furthermore, although the invention has been described with reference to specific exemplary embodiments, these descriptions are not meant to be construed in a limiting sense. Various modifications of the disclosed exemplary embodiments, as well as alternative exemplary embodiments of the invention will become apparent to persons of ordinary skill in the art upon reference to the description of the exemplary embodiments. It should be appreciated by those of ordinary skill in the art that the conception and the specific exemplary embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A wiring device with contact dampening, comprising:

a housing comprising a plurality of walls and forming a cavity therein;

a toggle assembly disposed at least partially within the cavity, the toggle assembly comprising:

a toggle;

a movable contact comprising a distal end and a proximal end, wherein the movable contact is coupled to the toggle at the proximal end; and a cradle comprising a central opening, wherein the toggle is pivotally coupled to the cradle and the movable contact extends through the central opening, a first stationary contact disposed within the cavity and at least partially aligned with the distal end of the movable contact; and a first dampening member comprising a base portion and a wall portion, the wall portion extending orthogonally from the base portion along a perimeter of the base portion and forming a slot therein, wherein an edge of the first stationary contact is disposed within the slot.

2. The wiring device with contact dampening of claim 1, wherein the first dampening member is fabricated using at least one material with dampening properties, wherein the dampening member absorbs and diminishes vibrations in the first stationary contact.

3. The wiring device with contact dampening of claim 2, wherein the first dampening member is fabricated using at least one material selected from a grouping consisting of rubber, silicon, plastic, and a viscoelastic material.

4. The wiring device with contact dampening of claim 1, comprising:

a second stationary contact disposed within the cavity of the housing and at least partially aligned with the distal end of the movable contact opposite the first stationary contact; and a second dampening member comprising a second base portion and a second wall portion, the second wall portion extending orthogonally from the second base portion along a perimeter of the second base portion and forming a second slot therein, wherein an edge of the second stationary contact is disposed within the second slot, wherein the movable contact pivots between being in conductive contact with the first stationary contact and being in conductive contact with the second stationary contact.

5. The wiring device with contact dampening of claim 1, wherein the dampening member is formed through injection molding.

6. The wiring device with contact dampening of claim 1, wherein the dampening member comprises two or more dampening pieces.

7. A wiring device with contact dampening, comprising:

a housing comprising a plurality of walls and forming a cavity therein;

at least one stationary contact disposed within the cavity of the housing; and at least one dampening member positioned in contact with at least a portion of the corresponding stationary contact, the at least one dampening member comprising a base portion and a wall portion, the wall portion extending orthogonally from the base portion along a perimeter of the base portion and forming a slot therein, wherein an edge of the corresponding stationary contact is disposed within the slot.

8. The wiring device with contact dampening of claim 7, wherein the at least one dampening member is fabricated using at least one material with dampening properties, wherein the at least one dampening member absorbs and diminishes vibrations in the at least one stationary contact.

9. The wiring device with contact dampening of claim 8, wherein the at least one dampening member is fabricated through an injection molding process or a die-cut process.

10. The wiring device with contact dampening of claim 9, wherein the at least one dampening member is fabricated using at least one material selected from a grouping consisting of rubber, silicon, plastic, and a viscoelastic material.

11. The wiring device with contact dampening of claim 7, wherein the at least one stationary contact comprises a first stationary contact and a second stationary contact and the at least one dampening member comprises a first dampening member and a second dampening member, wherein the second stationary contact is disposed within the cavity of the housing opposing the first stationary contact, and wherein the second dampening member is positioned in contact with at least a portion of the second stationary contact.

12. The wiring device with contact dampening of claim 11, wherein the first dampening member is formed integrally with the second dampening member.

13. The wiring device with contact dampening of claim 7, comprising:

a movable contact comprising a distal end and a proximal end, wherein the movable contact is coupled to a user interface at the proximal end and the distal end is at least partially aligned between the first stationary contact and the second stationary contact, wherein the movable contact pivotally swings between being in contact with the first stationary contact and the second stationary contact.

14. A wiring device with contact dampening, comprising:

a housing comprising a plurality of walls forming a cavity therein;

a toggle assembly disposed at least partially within the cavity, the toggle assembly comprising:

a toggle;

a movable contact comprising a distal end and a proximal end, wherein the movable contact is coupled to the toggle at the proximal end; and a cradle comprising a central opening, wherein the toggle is pivotally coupled to the cradle and the movable contact extends through the central opening;

a first stationary contact and a second stationary contact disposed within the cavity and at least partially aligned with the distal end of the movable contact; and a dampening member comprising:

a first bumper portion and a second bumper portion, wherein an edge of the first stationary contact is in contact with the first bumper portion and an edge of the second stationary contact is in contact with the second bumper portion;

a first bumper wall extending orthogonally from an outer edge of the first bumper portion along a portion of the first stationary contact and a second bumper wall extending orthogonally from an outer edge of the second bumper portion along a portion of the second stationary contact; and a first connector wall and a second connector wall, wherein the first connector wall extends from a first end of the first bumper wall to a first end of the second bumper wall, and the second connector wall extends from a second end of the first bumper wall to a second end of the second bumper wall.

15. The wiring device with contact dampening of claim 14, wherein the dampening member is fabricated using at least one material with dampening properties, wherein the dampening member absorbs and diminishes vibrations in the first and second stationary contacts.

* * * * *